United States Patent [19]

Moore et al.

[11] Patent Number: 4,838,460

[45] Date of Patent: Jun. 13, 1989

[54] PRODUCT DISPENSER HAVING ACTUATOR LOCKING COLLAR AND SHROUD

[75] Inventors: David G. Moore; Donald D. Foster, both of Lee's Summit, Mo.

[73] Assignee: Calmar Corporation, Lee's Summit, Mo.

[21] Appl. No.: 107,291

[22] Filed: Oct. 9, 1987

[51] Int. Cl.[4] ..... B67D 5/32

[52] U.S. Cl. ..... 222/153; 222/260; 222/321; 222/536; 222/384

[58] Field of Search ..... 222/153, 321, 260, 384, 222/531, 532, 536, 309, 402.11, 48

[56] References Cited

U.S. PATENT DOCUMENTS

| | | | |
|---|---|---|---|
| 3,062,411 | 11/1962 | Miles | 222/402.11 |
| 3,149,757 | 9/1964 | Safianoff | 222/153 |
| 3,474,939 | 10/1969 | O'Donnell et al. | 222/402.11 |
| 3,590,691 | 7/1971 | Magers | 222/384 |
| 3,884,392 | 5/1975 | Hazard | 222/153 |
| 3,907,174 | 5/1975 | Steiman | 222/321 |
| 4,433,799 | 2/1984 | Corsette | 222/309 |

*Primary Examiner*—H. Grant Skaggs

*Attorney, Agent, or Firm*—Hovey, Williams, Timmons & Collins

[57] ABSTRACT

A dispenser for lotions, creams and the like has an annular collar in the form of a rotatable cam ring which may be turned to rock an actuator toward a dispensing, open position or toward a closed, non-dispending position. The cam ring has cam tracks that support the actuator when in its open, dispensing position so that finger pressure exerted on the actuator to pump products from the dispenser does not inadvertently rock the actuator toward its closed position. In preferred forms of the invention, a wall section formed as part of a shroud surrounding the actuator is yieldably biased in an inwardly direction, and snaps over the outlet of the actuator to close the outlet channel once the actuator has been pivoted toward its closed, non-dispensing position.

15 Claims, 1 Drawing Sheet

PRODUCT DISPENSER HAVING ACTUATOR LOCKING COLLAR AND SHROUD

BACKGROUND OF THE INVENTION

1. Field of the Invention

The present invention relates to a pump dispenser for lotions, creams and the like and particularly concerns a dispenser having a rotatable collar for camming a rockable actuator toward either a dispensing or a non-dispensing position.

2. Description of the Prior Art

Certain pump dispensers for lotions, creams and other semi-viscous fluids are provided with an actuator that may be depressed for shifting a piston within a product holding chamber and thereby discharging the product through an outlet passageway. In some instances, the passageway extends through the actuator so that the latter also functions as a spout.

In general, earlier pump dispensers were often constructed with a single chamber, and an upper piston connected to the actuator cooperated with a lower, independent piston movable in a single direction as the upper piston was retracted and sub-atmospheric conditions were created within the chamber. The lower, independent piston typically was provided with teeth or other types of gripping means to prevent backward motion, although it was found that the teeth presented certain problems during manufacture.

Recently, increased attention has been directed toward pump dispensers having a reservoir chamber as well as a somewhat smaller pumping chamber which contains the pump piston. In these devices, a check valve located along a passageway between the large chamber and the small chamber substantially prevents pressure from the working piston to be directed into the larger chamber and toward the independent piston at the bottom of the same.

For the most part, single chamber pump dispensers as well as dual chamber pump dispensers are not provided with a relatively simple but effective means for retaining a depressible actuator in a locked position in order to avoid discharge of the product when external forces are unintentionally imposed on the actuator. As such, there is a continuing need for a device that overcomes these and other problems.

SUMMARY OF THE INVENTION

In accordance with the invention, a pump dispenser is provided with an annular, rotatable collar in the form of a cam ring which may be turned in one direction to rock a depressible actuator toward an open, product dispensing position wherein an outlet channel formed within a spout portion of the actuator is in communication with a pumping chamber for dispensing products. The collar may also be turned in an opposite direction to rock the actuator to a closed position and thereby substantially prevent communication between the pumping chamber and the outlet channel in the spout.

Advantageously, the cam ring is operable to lock the actuator in either the open, dispensing position or the closed, non-dispensing position. Thus, for example, the actuator is retained in its open position when depressed to pump products from the chamber and does not accidentally rock toward its closed position regardless of where the thumb or finger is placed in relation to the pivot axis of the actuator. By the same token, the cam ring is operable to lock the actuator in its closed position so that unintentional, pivotal movement of the same back toward its open position is largely precluded.

In preferred forms of the invention, an annular shroud coupled to the cam ring has a front, upstanding wall section which is oriented to cover the outlet of the actuator when the latter is rocked to its closed position. The upstanding wall section is biased inwardly toward the central axis of the dispenser and shifts toward a recess formed in the actuator beneath the spout when the actuator is rocked toward its dispensing position. As a consequence, the wall section substantially closes the gap between the shroud and the actuator when opened to discourage dispensed products from entering the space in the dispenser beneath the actuator.

In particularly preferred embodiments, the cam ring is formed with a projecting member which is positioned to slide within a cavity formed in the dispenser body when the cam ring has been rotated toward its position to open the actuator and the actuator is depressed. However, the member is out of alignment with the cavity in the body once the cam ring has been turned to close the actuator, and is instead disposed in interfering relationship to a flange of a dispenser body therebelow. The projecting member comes into contact with the body to substantially prevent further downward movement of the actuator is an attempt is made to depress the actuator when the cam ring has rocked the same toward its closed position.

DETAILED DESCRIPTION OF THE DRAWINGS

Figure 1:
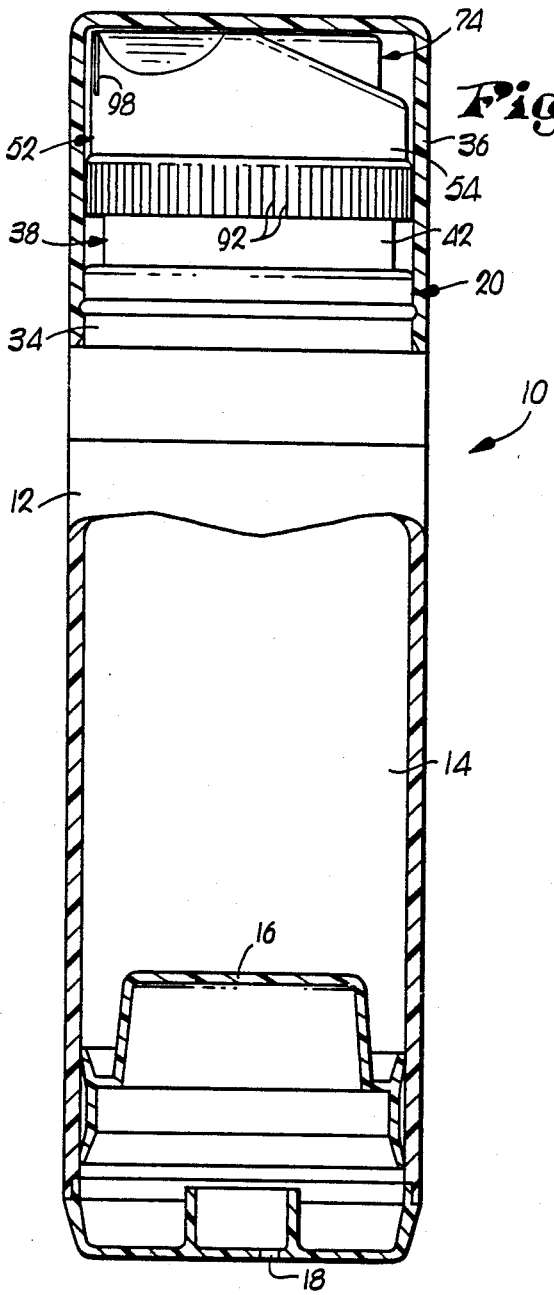
FIG. 1 is a side elevational view of a product dispenser constructed in accordance with the principles of the present invention, with a casing wall and a cap cut away in section to reveal a product storage chamber as well as an overlying actuator, cam ring and shroud assembly.
Figure 2:
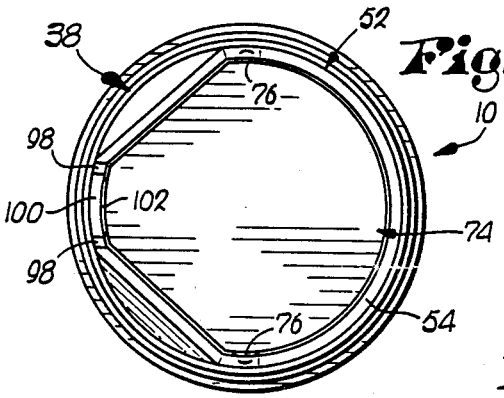
FIG. 2 is a plan view of the dispenser shown in FIG. 1 with the cap removed.

A product dispenser for lotions, creams and the like is designated broadly by the numeral 10 in FIGS. 1–5 and includes an elongated, tubular, cylindrical casing 12 that is best illustrated in FIG. 1. Interior walls of the casing 12 define a chamber or reservoir 14 for storing a quantity of the products, and a piston 16 disposed to one side of the products is shiftable upwardly within the reservoir 14 whenever atmospheric pressure of air entering through a vent 18 is somewhat greater than pressure conditions within the reservoir 14 above piston 16.

Figure 3:
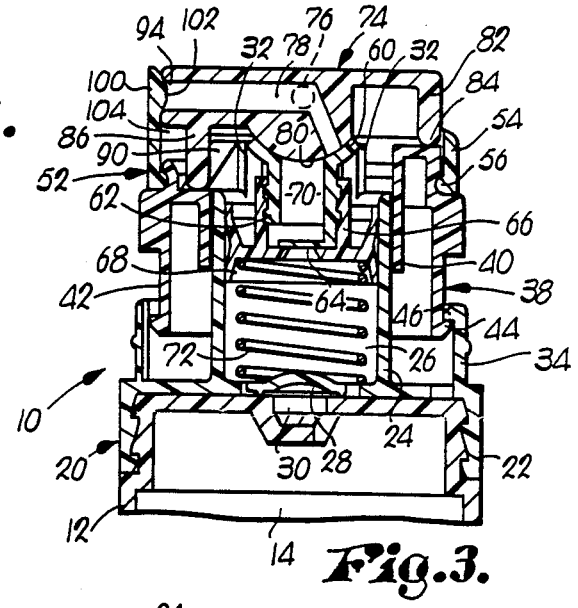
FIG. 3 is a fragmentary, side crosssectional view of the actuator, cam ring and shroud assembly shown in FIG. 1.
Figure 4:
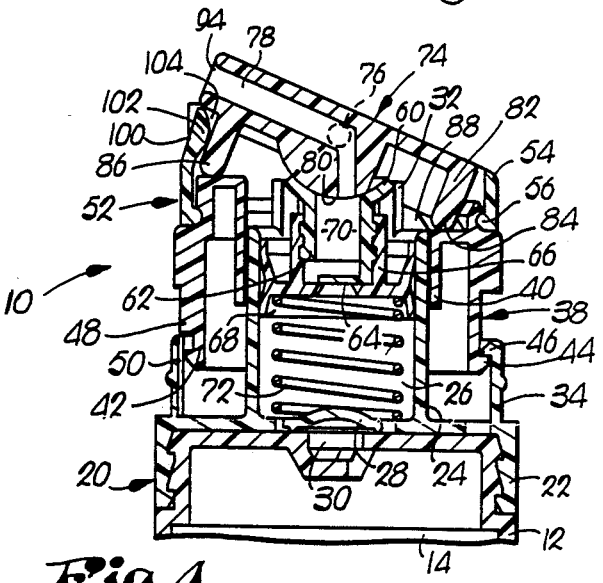
FIG. 4 is a view somewhat similar to FIG. 3 except that the cam ring has been turned to shift the actuator to an inclined, open position for dispensing products.

Referring now to FIGS. 3 and 4, a valve body 20 has a depending, outer, generally cylindrical wall 22 that is snap-fit over a ribbed, upper recessed portion of the cylindrical casing 12. The valve body 20 also includes an internal, upstanding cylindrical wall 24 defining a product holding chamber 26. A disc-shaped check valve 28 is formed as part of the valve body 20 and extends across an inlet opening 30 communicating with reservoir 14 for admitting products from the latter into chamber 26, while substantially preventing retrograde flow of the products back into the reservoir 14.

Figure 5:
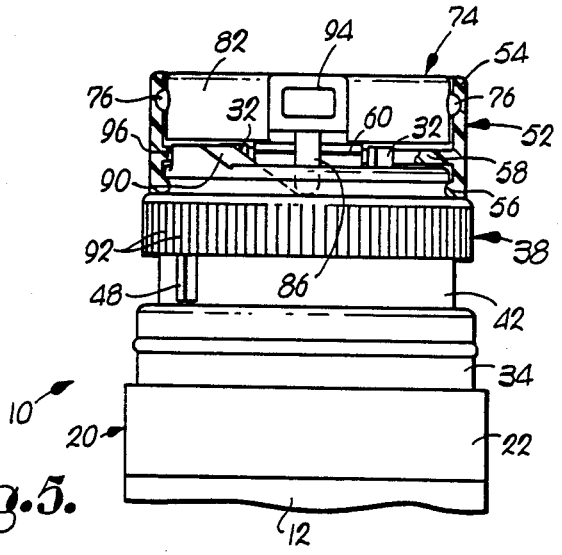
FIG. 5 is a fragmentary, front elevational view of the dispenser shown in FIGS. 1–4 with the shroud cut away in section to illustrate, among other things, the pivotal connection between the actuator and the shroud.

Four upstanding legs 32, two of which are shown in FIGS. 3–5, are integrally connected to an upper circular edge of cylindrical wall 24. In addition, a generally cylindrical wall 34 intermediate and concentric with walls 22, 24 includes an annular rib that mates, in snap interference fashion, with an annular groove formed in a lower portion of a cap 36 that is shown in FIG. 1.

An annular locking collar or cam ring 38 includes an inner cylindrical wall 40 telescopically received over an upper portion of the wall 24 of valve body 20. Cam ring 38 also includes an outer, somewhat cylindrical wall 42 having a lower, outwardly extending peripheral lip 44 hat is engageable with a flange 46 that extends inwardly around the substantial extent of an upper, annular portion of valve body wall 34. An outwardly protubering, somewhat bar-shaped member 48 (FIGS. 4 and 5) is integrally formed as part of the cam ring wall 42, and is slidably received within a gap or cavity 50 (FIG. 4) that is presented due to the absence of flange 46 in a relatively small, upper internal section of wall 34.

An annular shroud 52 has an outer, somewhat cylindrical wall 54 that is formed to present an inwardly extending, rounded shoulder 56 which is disposed in an annular, rounded groove of cam ring 38. The shoulder 56 is somewhat loosely received in the groove of cam ring 38 to enable rotation of the latter as will be further described hereinbelow.

A web 58, as illustrated in FIG. 5, integrally connects opposed, internal portions of shroud wall 54 and presents an upwardly facing, concave or partial cylindrical wall portion 60 that is coupled to a depending, tubular wall portion 62. The ribbed, cylindrical, vertical wall portion 62 is connected to upstanding, circular structure 66 of a piston 68, the latter of which is reciprocable within the chamber 26 along a vertical axis.

A disc 64 integral with wall portion 62 is yieldable in an upwardly direction as the piston 68 moves downwardly within chamber 26 to thereby admit products from the chamber 26 and into a passage 70 centrally located along the vertical axis of wall portion 62. A compression spring 72 engages a lower horizontal wall of the valve body 20 in surrounding relation to check valve 28 and extends upwardly toward a cavity formed in the bottom of piston 68 to bias the latter in an upwardly direction. A circular hole in the center of piston 68, as shown in FIGS. 3 and 4, communicates with passage 70 when the disc 64 is opened.

A spout or actuator 74 has two opposed, semi-spherical projections 75 as best shown in FIG. 5 which rest in complemental recesses formed in opposite sides of shroud 52. The projections 76 function as a pivot means to enable the actuator 74 to rock about a horizontal axis transverse to the central axis of chamber 26 and reservoir 14. The projections 76 enable pivotal movement of the actuator 74 between a first, inclined position that is shown in FIG. 4 and a second, or generally horizontal position that is shown in FIG. 3.

When the actuator 74 is in its inclined position depicted in FIG. 4, a channel 78 extending within actuator 74 is in communication with passage 70. Alternatively, when the actuator 74 is in the second or horizontal position shown in FIG. 3, the channel 78 is substantially out of communication with passage 70 inasmuch as the inlet to channel 78 is closed by curved wall portion 60. The inlet of channel 78 is formed in a curved wall portion 80 of actuator 74 having a somewhat semi-cylindrical configuration complemental to the shape of curved wall portion 60, such that the wall portions 60, 80 are in sliding engagement as the actuator 74 is rocked between its first and second positions.

The actuator 74 has an outer, peripheral wall 82 that is formed to present a rear, depending knob 84 (FIGS. 3 and 4) as well as a longer, depending front post 86 (FIGS. 3–5). The rear knob 84 is slidably engageable with an upwardly facing, back cam track 88 (FIG. 4) which is formed as part of the cam ring 38, while post 86 is slidably engageable with a front cam track 90 (FIGS. 3–5) which is also formed as part of cam ring 38.

An outer edge of the cam ring 38 is provided with a number of upstanding ridges 92 as shown in FIGS. 1 and 5. Thus, once the ridges 92 are grasped and the cam ring 38 is rotated, the knob 84 rides along the curved back track 88 while the post 86 travels along the curved front cam track 90. The cam ring 38 is depicted in one end of its path of rotational travel in FIG. 4, where it can be seen that the front post 86 is engaged with an upper portion of the front cam track 90 while the rear knob 84 is in contact with a lower portion of the back cam track 88. In this position of the cam ring 38, therefore, the actuator 74 is retained in its first or dispensing position wherein, as previously described, channel 78 is in communication with passage 70 for dispensing products. Alternatively, when the cam ring 38 is rotated in an opposite direction about a vertical axis, the front post 86 rides down the front cam track 90 while the rear knob 84 rides up the back cam track 88 to thereby shift the actuator 74 toward its second or closed position shown in FIGS. 1–3 and 5 wherein channel 78 is substantially out of communication with passage 70.

When the cam ring 38 has shifted the actuator 74 to its first or open position as illustrated in FIG. 4, the outwardly projecting member 48 cavity 50 formed between opposed end segments of valve body flange 46. As such, the actuator 74 may be depressed to shift piston 68 downwardly at the same time that member 48 is longitudinally or vertically received in cavity 50. The cylindrical configuration of wall 40 in sliding engagement with valve body wall 24 substantially retains the cam ring 38 in concentric alignment with valve body 20 as the actuator 74 moves up or down.

During depression of actuator 74, the pressure exerted by the piston 68 which chamber 26 closes check valve 28 and forces products within chamber 26 upwardly past yieldable disc 64 and into passage 70, whereupon the products are shifted through channel 78 and out of an outlet 94 formed on the end of the spout or actuator 74. The wall portions 60, 62 of shroud 52 thereby function as structure connected to the piston 68 for movement of the same as the actuator 74 is depressed. Outer ends of the curved wall portions 60 of shroud 52 ride within the confines of the four upstanding legs 32, so that alignment of the actuator 74 with piston 68 and valve body 20 is facilitated.

Once finger pressure on actuator 74 is relieved, compression spring 72 urges the piston 68 upwardly to simultaneously lift cam ring 38 and shroud 52 until lip 44 comes into contact with flange 46. During upward or return movement of piston 68, the check valve 28 lifts to admit another charge of products from reservoir 14 and into chamber 26 while disc 64 closes to establish subatmospheric conditions.

When a sufficient quantity of product has been dispensed, the cam ring ridges 92 are grasped and the ring is rotated in an opposite direction to cause the front post 86 to ride down the front cam track 90 while the rear knob 84 rides up the back cam track 88. The camming action presented by the curved tracks 88, 90 causes the actuator 74 to be returned to its second, closed or horizontal disposition as shown in FIG. 3. As s result, the inlet of channel 78 is closed by curved wall portions 60 to substantially prevent additional flow of products into the channel 78. In addition, member 48 of cam ring 38 is now in a position overlying a portion of the flange 56 such that the member 48 comes into contact with flange 46 if an attempt is made to depress actuator 74, thereby precluding further downward movement of actuator 74 and piston 68.

Referring now to FIG. 5, it can be seen that a rear surface 96 of front cam track 90 comes into contact with web 58 to thereby define one end limit of the extent of rotational travel of cam ring 38, inasmuch as the web 58 of shroud 52 is held in stationary relation relative to valve body 20 and casing 12. Although not shown, another portion of web 58 contacts a rear surface of the back cam track 88 when the cam ring 38 is shifted to the position shown in FIG. 3, to thereby define an opposite end limit of travel for cam ring 38 and to ensure that the member 48 is in alignment with cavity 50 for proper insertion into the same during depression of actuator 74.

Finally, a front portion of shroud 52 is constructed to present two vertical slots 98 located on opposite sides of an upstanding wall section 100 of shroud 52. As illustrated in FIG. 3, an inner, upper portion of the wall section 100 presents a protuberance 102 that is somewhat complemental in configuration to the rectangular outlet 94 (See FIG. 5) of actuator channel 78. When the actuator 74 is in its horizontal, or closed position, the protuberance 102 effectively closes and covers the channel outlet 94 to prevent entry of dirt, foreign objects or the like.

the wall section 100 is inwardly biased toward the vertical, central axis of dispenser 10. When the actuator 74 is rocked to its open, dispensing position as shown in FIG. 4, the inherent bias of wall section 100 causes the same to shift inwardly and come to rest within a recess 104 (FIGS. 3 and 4) below the outlet 94 of actuator 74 and the front post 86 of the same. As such, the wall section 100 closes the gap that might otherwise exist between the outlet 94 and the shroud 52 when the actuator 74 is opened, to thereby largely prevent entry of dispensed products into the space within shroud 52 and beneath actuator 74. Consequently, the dispensed products are substantially kept out of reach from moving components within dispenser 10.

As can now be appreciated, the present invention represents an especially effective means for retaining the actuator 74 in either an opened position for dispensing, or a closed position when further quantities of the products are not needed. Cam ring 38 thereby prevents inadvertent rocking motion of the actuator 74 as might otherwise occur when the actuator 74 is depressed to dispense products from chamber 26. It is recognized, of course, that those skilled in the art may make various modifications or additions to the currently preferred embodiment shown in the drawings, and therefore it is to be understood that the invention should be deemed limited only by a fair scope of the claims that follow.

We claim:

1. A dispenser comprising:

a body having walls defining a product holding chamber;

a piston reciprocable in said chamber;

structure connected to said piston for movement therewith and having walls defining a passageway for the flow of products from said chamber;

a depressible actuator connected to said structure for shifting of the latter to thereby move said piston, said actuator including walls defining a channel therethrough and an outlet in communication with said channel, said actuator being pivotally connected to said structure for selective, rocking movement through an arc between a first position and a second position, said channel being in communication with said passageway when said actuator is in said first position for enabling products to flow from said chamber and through said outlet during at least a portion of a depression stroke of said actuator, said channel being substantially out of communication with said passageway when said actuator is in said second position for generally precluding the flow of products through said outlet; and means comprising a rotatable cam ring in sliding engagement with said actuator for shifting said actuator toward a selected one of said first position and said second position and for retaining said actuator in said selected position.

2. The invention as set forth in claim 1, wherein said cam ring surrounds a portion of said chamber.

3. The invention as set forth in claim 1; and including means for substantially preventing depression of said actuator when said actuator is in said second position.

4. The invention as set forth in claim 1, wherein said cam ring is shiftable with said actuator as the latter is depressed when said actuator is in said first position.

5. The invention as set forth in claim 1; and including a shroud connected to said cam ring for covering said outlet of said actuator when said actuator is in said second position.

6. The invention as set forth in claim 5, wherein said actuator is rotatable relative to said shroud.

7. The invention as set forth in claim 5, wherein said shroud includes a wall section that is yieldably biased toward a position covering said outlet of said actuator when said actuator is in said second position.

8. A dispenser comprising:

a body having walls defining a product holding chamber;

a piston reciprocable in said chamber;

structure connected to said piston for movement therewith and having walls defining a passageway for the flow of products from said chamber;

a depressible actuator connected to said structure for shifting of the latter to thereby move said piston, said actuator including walls defining a channel therethrough and an outlet in communication with said channel, said actuator being pivotally connected to said structure for selective, rocking movement through an arc between a first position and a second position, said channel being in communication with said passageway when said actuator is in said first position for enabling products to flow from said chamber and through said outlet during at least a portion of a depression stroke of said actuator, said channel being substantially out of communication with said passage when said actuator is in said second position for generally precluding the flow of products through said outlet;

means for shifting said actuator toward a selected one of said first position and said second position and for retaining said actuator in said selected position, said means for shifting said actuator toward said first or second positions comprising a cam ring; and means for substantially preventing depression of said actuator when said actuator is in said second position, said means for substantially precluding depression of said actuator comprising a member connected to said cam ring and engagable with said body when said actuator is in said first position.

9. A dispenser comprising:

a body having walls defining a product holding chamber;

a piston shiftable within said chamber through a pumping stroke and a return stroke;

an actuator shiftably coupled to said body for selective reciprocable movement relative to said body along a reference axis as well as for selective pivotal movement relative to said body about an axis generally transverse to said reference axis between a first position and a second deposition, said actuator including walls defining an outlet channel in communication with said chamber during at least a portion of the pumping stroke of said piston for enabling discharge of products from said chamber and through said channel when said actuator is in said first position, said channel of said actuator being substantially out of communication with said chamber when said actuator is in said second position;

means connecting said actuator to said piston for shifting of the piston along said pumping stroke during movement of said actuator along said reference axis in order to pump products through said outlet channel of said actuator when said actuator is in said second position; and means including a rotatable cam ring in sliding engagement with said actuator for shifting said actuator toward either of said first and second positions.

10. The invention as set forth in claim 9, wherein said actuator walls curved in an arc about said pivotal axis, and wherein said means connecting said actuator to said piston includes curved wall portions complemental in configuration to said curved walls of said actuator, said curved wall portions substantially blocking the flow of products through said channel when said actuator is in said second position.

11. The invention as set forth in claim 9; and including a wall section connected to said body and engagable with said actuator for covering said outlet channel when said actuator is in said second position.

12. The invention as set forth in claim 9, wherein said means for selectively shifting said actuator includes means for retaining said actuator in said first or said second position.

13. A dispenser comprising:

a body having walls defining a product holding chamber;

a piston reciprocable in said chamber;

structure connected to said piston for movement therewith and having walls defining a passageway for the flow of products from said chamber;

a depressible actuator connected to said structure for shifting said structure to thereby move said piston, said actuator including walls defining a channel therethrough and an outlet in communication with said channel, said actuator being pivotally connected to said structure for selective, rocking movement between a first position and a second position about an axis generally transverse to the axis of reciprocation of said piston, said channel being in communication with said passageway when said actuator is in said first position for enabling products to flow from said chamber during at least a portion of the depression stroke of said actuator, said channel being substantially out of communication with said passageway when said actuator is in said second position for generally precluding the flow of products to said channel; and means including a rotatable cam ring in sliding engagement with said actuator for shifting said actuator toward either of said first and second positions.

14. The invention as set forth in claim 13; and including means for selectively retaining said actuator in either of said first position or said second position.

15. The invention as set forth in claim 13; and including a wall section engageable with said actuator for covering said outlet of said channel when said actuator is in said second position, said wall section being biased toward a position within a recess of said actuator when said actuator is in said first position.

* * * * *